United States Patent [19]

Dryman et al.

[11] Patent Number: 4,654,768

[45] Date of Patent: Mar. 31, 1987

[54] LUMINAIRE INCLUDING IMPROVED REFRACTOR MOUNTING ARRANGEMENT

[75] Inventors: William K. Dryman; Walter R. Blake; Warren Halper, all of Hendersonville, N.C.

[73] Assignee: General Electric Company, Schenectady, N.Y.

[21] Appl. No.: 910,037

[22] Filed: Sep. 19, 1986

[51] Int. Cl.[4] ..... F21V 17/00

[52] U.S. Cl. ..... 362/374; 362/311; 362/396

[58] Field of Search ..... 367/223, 267, 308, 310, 367/311, 374, 375, 396

[56] References Cited

U.S. PATENT DOCUMENTS

| | | | |
|---|---|---|---|
| 3,431,003 | 3/1969 | Bacon, Jr. et al. | 362/374 X |
| 4,031,382 | 6/1977 | Laughter | 362/374 |
| 4,414,614 | 11/1983 | McMahan et al. | 362/374 X |
| 4,516,196 | 5/1985 | Blake | 362/311 |

*Primary Examiner*—Stephen F. Husar

*Attorney, Agent, or Firm*—John P. McMahon; Philip L. Schlamp; Fred Jacob

[57] ABSTRACT

A luminaire comprising separable means arrangement for hingedly mounting a refractor on the rim of the reflector of the luminaire is disclosed. The separable means is comprised of a hinge clip having two hooked extensions at one side which engage raised slotted sections located at each end of a split clampband. The hooked extensions of the hinge clip are removably retained in the raised slotted sections and cannot be easily backed out. The hinge clip is self retained to the clampband by means of an interaction between a resilient gasket and the clampband. The gasket is positioned inside of the clampband and exerts an outward force on the clampband and provides effective sealing between the clampband and the refractor and between the clampband and the reflector flange. The other side of the hinge clip has means for hingedly mounting the refractor to the reflector.

14 Claims, 5 Drawing Figures

LUMINAIRE INCLUDING IMPROVED REFRACTOR MOUNTING ARRANGEMENT

BACKGROUND OF THE INVENTION

This invention relates to luminaires comprising a fixed lamp housing assembly, a reflector and a light-transmitting refractor assembly having separable means for hingedly fastening the refractor assembly to the reflector but allowing easy separation for installation and service.

It is necessary to have convenient access to the interior of luminaires for lamp replacement and service. A common separable means arrangement for ceiling-mounted luminaires is to hinge the refractor to the lamp housing at one side so that the refractor may be swung on the housing between closed and opened positions. Latch means are provided for locking the refractor in a closed position and for releasing it to give access to the interior. One such latch means is disclosed in U.S. Pat. No. 4,516,196 of W. R. Blake assigned to the same assignee as the present invention and herein incorporated by reference.

The refractor may vary from a simple flat light-transmitting plate or lens serving primarily as a window to keep out dirt and water, to an elaborately faceted clear bowl serving also to refract and redirect the light in particular directions.

The use of plastic instead of glass for the refractor has made relatively large low brightness luminaires practical for indoor use with low mounting heights. The refractor may be attached to the luminaire by separable means comprising metal clampbands, latches and hinges. The hinges of such an arrangement have heretofore comprised several parts such as welded clips, hinge pins and washers. The assembly of such hinges can disadvantageously require multiple operations which makes such hinges elaborate and relatively expensive. It is desired that hinges be provided which are simpler and less costly yet perform as well as or better than those that have been available in the prior art.

Accordingly, it is an object of the present invention to provide a new and improved luminaire assembly having a refractor assembly with separable means comprising a simple hinge for hingedly fastening the refractor to the luminaire assembly in a sealed manner but allowing easy separation for installation and service purposes.

SUMMARY OF THE INVENTION

The present invention is directed to a luminaire assembly having a refractor with separable means comprising a hinge clip for hingedly fastening the refractor to a reflector of the luminaire assembly.

The luminaire assembly comprises an upper housing, a reflector having attachment means and a radially projecting flange portion, a refractor assembly adapted to close the underside of the reflector, and separable means for hingedly fastening the refractor assembly to the reflector. The refractor has a rim portion overhung by and adapted to mate with the projecting flange of the reflector. The refractor assembly comprises a flexible clampband extending around the periphery of the refractor and having upper and lower rim sections extending respectively over the top and bottom surfaces of the rim portion of the refractor. The clampband may have a plurality of circumferentially spaced slotted sections. The clampband is split and has the ends thereof spaced a predetermined distance with each the ends having a raised slotted section. The refractor assembly further comprises resilient means cooperating with the clampband and effective for normally urging the ends thereof apart. The refractor assembly further comprises fastening means which may comprise a plurality of latches disposed around the periphery of the clampband and respectively pivotally connected to the plurality of circumferentially spaced slotted sections of the clampband. The separable means further comprises a hinge clip for hingedly fastening the refractor to the reflector. The hinge clip has one side having means for pivotally connecting it to the attachment means of the reflector. The hinge clip has its other side formed with a spaced pair of hooked extensions having indentations formed in the opposed edges thereof. The hooked extensions are insertable into the raised slotted sections in the clampband ends when the clampband and the resilient means are in a compressed state. The raised slotted sections of the clampband are urged into the indentations when the clampband and resilient means are in an expanded state thereby to effect retention of the hinge clip on the clampband.

DETAILED DESCRIPTION OF THE PREFERRED EMBODIMENTS

Figure 1:
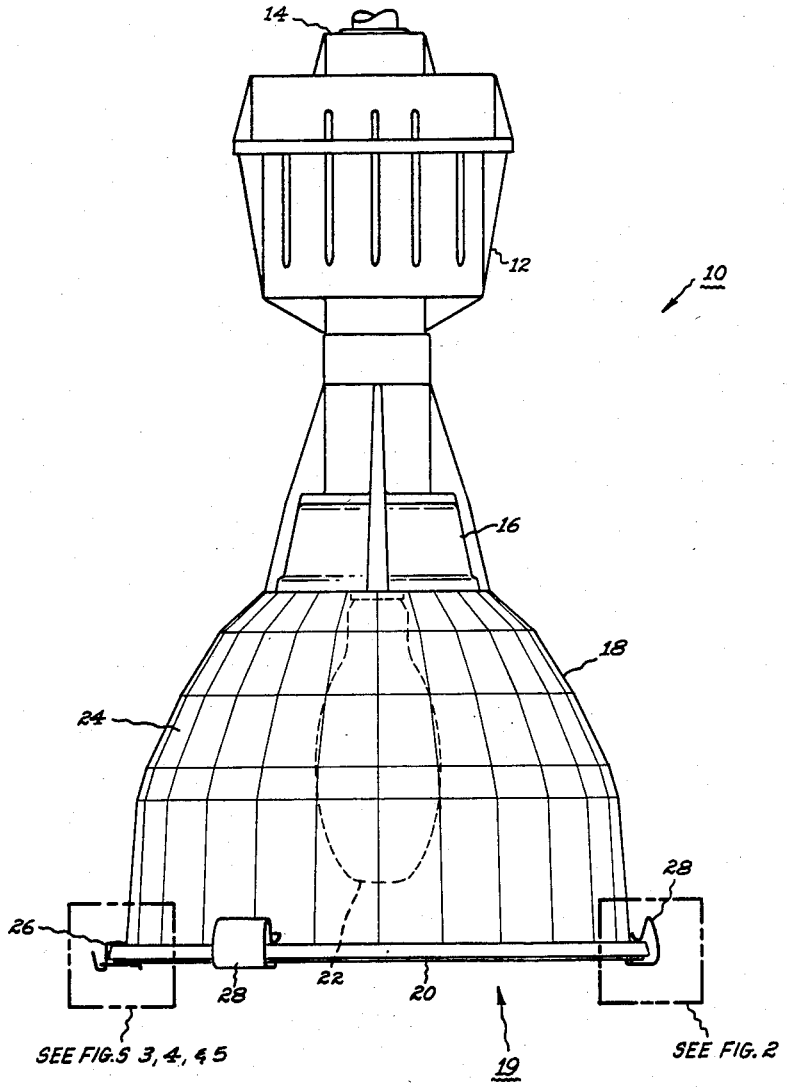
FIG. 1 is a side elevation view of a luminaire embodying the invention.

Referring now to the drawing and more particularly to FIG. 1, there is shown a industrial type luminaire 10. The luminaire comprises a ballast housing 12 having a top-mounting hub 14 for attachment to a metal conduit or pipe. The ballast housing 12 contains the electrical operating components such as a ballast transformer and a capacitor (not shown), and the usual wiring compartment.

Suspended from the ballast housing is an optical assembly comprising a lamp housing 16, a reflector 18 and a refractor assembly 19 including a refractor 20. The lamp housing contains socket means for accommodating a high intensity discharge lamp 22, shown in phantom, ordinarily a metal halide, mercury or a high pressure sodium vapor lamp. The reflector 18 is shaped and preferably is polished aluminum.

The refractor 20 is a substantially flat member which is preferably formed of glass. The refractor may also be formed of a transparent high impact plastic or other light transmissive material.

The refractor assembly 19 is hingedly fastened to one side of the reflector 18 by means of the refractor separable means comprised of elements to be described with regard to FIGS. 2–5. The refractor assembly may be sealingly locked against the reflector by fastening means such as a plurality of latches 28 disposed around the periphery of a clampband 30, to be described with reference to FIGS. 2–5, and respectively connected to a plurality of circumferentially spaced slotted sections in the clampband. Preferably three latches 28 are used which are circumferentially located and spaced from each other by 120°. In the normal closed position of the refractor assembly, the weight of the refractor assembly is taken up substantially entirely by the latches. The 120° locations of the latches assures substantially even pressure against resilient means 32 shown in FIG. 2.

Figures 2, 3, 4, 5:
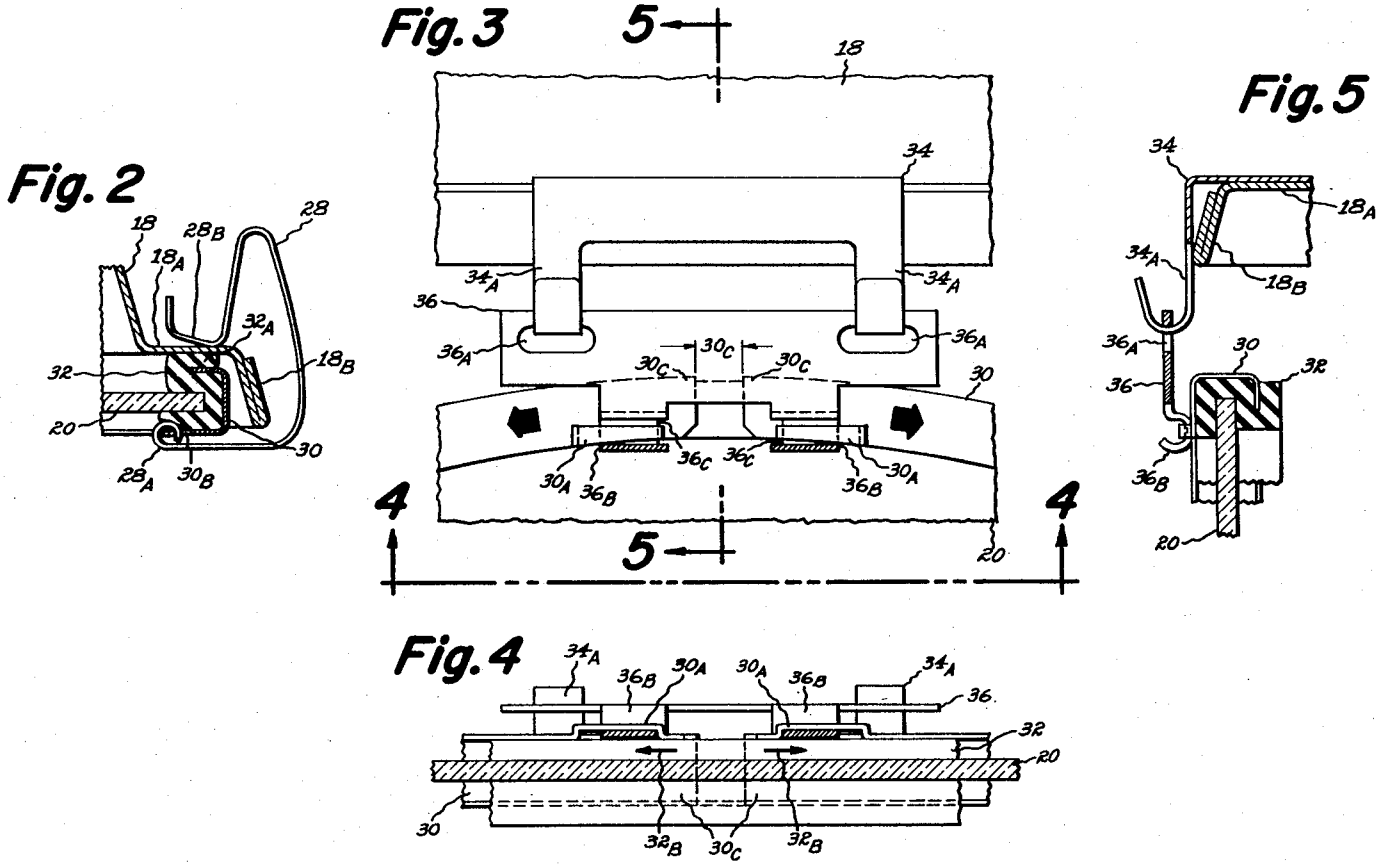
FIG. 2 is a sectionalized view of a latch clamp of the type used in the present invention.
FIG. 3 is a fragmentary view of the refractor mounting means of the present invention in its open position.
FIG. 4 is a partially sectioned view of the refractor mounting means taken along lines 4—4 of FIG. 3.
FIG. 5 is a sectionalized view of the refractor mounting means taken along lines 5—5 of FIG. 3.

The resilient means 32 is comprised of a soft resilient material such as sponge rubber or other elastomeric material. As will be discussed hereinafter with regard to FIG. 4, the resilient means cooperates with the clampband and is effective for normally urging the ends of the clampband apart. The resilient means preferably comprises a resilient gasket fitted about the rim of the refractor 20 and positioned in the clampband 30 as shown in FIG. 2. The resilient gasket also includes sealing sections extending inwardly over the upper and lower portions of the refractor rim. The resilient gasket further includes a rim section $32_A$ extending over the outer edge of the clampband for serving as a seal between the clampband and the reflector 18 when the refractor assembly is in its raised closed position show in FIG. 1.

The clampband 30 is a flexible material such as steel. The flexible clampband extends around the periphery of the refractor 20 and may have upper and lower rim sections extending respectively over the top and bottom surfaces of the rim portion of the refractor. The clampband may also be L-shaped with the upper or lower section devoid of any structure. The clampband is split and has, as will be discussed with regard to FIG. 3, ends spaced apart a predetermined distance with each of the ends having a raised slotted section $30_A$.

The clampband 30 additionally has circumferentially spaced slotted sections $30_B$ around its periphery at locations corresponding to the previously discussed locations of the fastening means or latches 28. The latches may be formed of resilient material such as steel also and are pivotally connected to the clampband by means of looped portions $28_A$ of latches 28. The latches 28 may, for example, when in clamping position have top looped portions $28_B$ which resiliently and releasably engage the top surface of a radially projecting flange $18_A$ formed on the reflector 18 and having a peripheral skirt portion $18_B$ which is doubled over for increased rigidity at the rim.

The latches 28 may be dimensioned to span between the lower or bottom portion of the clampband 30 and the upper or top projecting flange portion $18_A$ of the reflector 18 for providing direct resilient clamping therebetween. The latches are further dimensioned to press substantially perpendicularly against the upper surface of the portion $18_A$ and resiliently urge the clampband upwardly against the reflector flange with the section $32_A$ of the gasket compressed therebetween to effect a seal.

The refractor assembly is hingedly fastened to the reflector by attachment means 34 connected to the reflector and a cooperating hinge clip 36 connected to the clampband 30, all as shown in FIG. 3 illustrating the refractor assembly in an open or hung down position from the reflector 18. The attachment means comprises two spaced apart extending hooked portions $34_A$ which fit into and engage two complementary slotted sections $36_A$ located at one side of the hinge clip 36. If desired, other arrangements for connecting the hinge clip to the attachment means may be accomplished. For example, the hingedly fastening arrangement may be reversed with the attachment means having the complementary slotted sections and the hinge clip having the extending hook portions formed thereon.

The other side or second portion of the hinge clip 36 is formed with a spaced pair of hooked extensions $36_B$ having indentation portions $36_C$ in opposed edges of the hooked extensions. The hooked extensions $36_B$ are insertable into the raised slotted sections $30_A$ located at each end $30_C$ of clampband 30, whereas, the indentation portions $36_C$ internally engage the raised slotted sections $30_A$. The insertability of the hooked extensions $36_B$ and the engageability of the indentation portions $36_C$ are respectively dependent upon the compressed and expanded states of the resilient means 32 and clampband 30.

The clampband 30 is shown in FIG. 3 in its expanded or non-compressed state with its two ends $30_C$ separated by a predetermined distance $30_D$ having a value such as 70 mm. In order to insert the hooked extensions $36_B$ into the raised slotted section $30_A$, the clampband 30 along with the resilient means 32 mating with the clampband must first be compressed or squeezed so that the ends $30_C$ of the clampband move toward each other a sufficient distance so that the hooked extensions $36_B$ may be inserted into their respective slotted sections $30_A$. After such insertion, the clampband is then released from its squeezed or compressed state and its ends $30_C$ move away from each other so that the clampband seeks an extended state until the indentation portions $36_C$ internally and frictionally engage the raised slotted sections $30_A$.

From FIG. 3 it should be noted that for the attachment of the hinge clip 36 to the clampband 30, the clampband 30 and the resilient means 32 must be sufficiently compressed so that the ends $30_B$ of the clampband 30 are brought close enough to each other to allow the hooked extensions $36_B$ to be inserted into the allowable opening of the raised slotted sections $30_A$ of the clampband. Further, if it is desired to remove an already installed refractor 20 from the clampband 30 for replacement purposes, the clampband 30 and the resilient means 32 must be sufficiently compressed so that the ends $30_B$ of the clampband are brought close enough to each other to allow the hooked extensions 36 to be removed from the opening of the slotted section $30_A$ of the clampband 30.

When the refractor is mated with clampband, the indentation portions $36_C$ maintain the engagement of slotted sections $30_A$ and the hinge clip is retained to the clampband due to the cooperation of the resilient means 32 with the clampband 30 effective for normally urging the ends of clampband apart from each other which may be described with reference to FIG. 4 showing a view taken along 4—4 of FIG. 3.

The resilient means 32 is dimensioned relative to the clampband 30 so as to exert an outward force, shown by arrows $32_B$, on the clampband 30 which keeps the ends $30_C$ of clampband 30 separated from each other by the predetermined distance $30_D$, which, in turn, maintains the internal frictional engagement of the indentation portions $36_C$ with the raised slotted section $30_A$ and thus the hinge clip is self retained to the clampband.

Although the above describes the resilient means as being positioned within the entire clampband so as to urge the ends of the clampband apart from each other, it will be recognized that the resilient means need only cooperate with the opposed split ends of the clampband so that the ends of the clampband are normally resiliently urged apart.

Further, although the above description notes the benefits of hingedly fastening of the refractor assembly to the reflector, it will be recognized that the easy detachability of the hinge clip to the clampband is beneficial with regard to the replacement of the refractor of the luminaire assembly if such a need arises.

Further details of the interconnection of the hinge clip 36 with the clampband 30 along with the attachment means 34 are shown in FIG. 5 which is a view taken along lines 5—5 of FIG. 3. The hinge clip 36 is engaged by the clampband 30 and abuts up against the outer surface of the clampband. The hinge clip 36 is pivotally connected to hooked portion $34_A$ of attachment means 34 which abut up against the doubled-back portion $18_B$ of the reflector.

It will now be appreciated that the present invention provides a luminaire assembly having a refractor assembly with separable means comprised of a relatively simple but self-retaining hinge clip. The self-retaining hinge clip is easily connected to the attachment means of the reflector and does not have the disadvantage of the prior art devices comprised of multiple parts and requiring multiple operations for their assembly. Additionally the hinge clip arrangement in cooperation with the split clampband and resilient gasket enable easy removal of the hinge clip should it be necessary to disassemble the refractory assembly to repair or replace the refractor or gasket. The hinge clip of the present invention solves the prior art problems in that it is attached to the two surfaces of the clampband in such a way as to securely lock the clampband together in a rapid assembly and easy disassembly fashion.

It should be further appreciated, that although the refractor separable means has been described for use with luminaires hingedly fastening the refractor to the reflector, other uses of the separable means are contemplated by practice of this invention. The separable means may, for example, be used to hingedly mount clampbands wrapped around any type of panel member used in lighting assemblies so as to provide access for lamp replacement purposes. For such arrangements of separable means, it is only necessary that a resilient device cooperate with and exert a force on the clampband urging apart the end of the clampband so that the hinge clip is self-retained to the clampband.

We claim:

1. Means for hingedly mounting a panel member on a lighting assembly comprising:

a flexible clampband extending around the periphery of the panel member, said clampband being split and having the ends thereof spaced a predetermined distance with each said ends having a raised slotted section;

resilient means cooperating with said clampband and effective for normally urging the ends thereof apart; and a hinge clip having one side formed with a spaced pair of hooked extensions with indentations in the opposed edges thereof, said hooked extensions being insertable into said raised slotted sections in the clampband ends when said clampband and said resilient means are in a compressed state and said raised slotted sections of said clampband being urged into said indentations when said clampband and resilient means are in an expanded state thereby to effect retention of said hinge clip on said clampband.

2. Means for hingedly mounting according to claim 1 wherein said flexible clampband has a rim section extending over a rim portion of said panel.

3. Means for hingedly mounting according to claim 1 wherein said flexible clampband has upper and lower rim sections extending respectively over the top and bottom surfaces of the rim portion of said panel member.

4. Means for hingedly mounting according to claim 1 wherein said resilient means comprises a resilient gasket fitted about the rim of said panel member and positioned in said clampband.

5. Means for hingedly mounting according to claim 4 wherein said resilient gasket includes sealing sections extending inwardly over the upper and lower rim portions of said panel member.

6. Means for hingedly mounting according to claim 4 wherein said resilient gasket further includes a rim section extending over the outer edge of said clampband for serving as a seal between said clampband and lighting assembly.

7. A luminaire comprising (1) an upper housing assembly for a light source, (2) a reflector having refractor attachment means and a rim portion with a radially projecting flange, (3) a refractor adapted to close the underside of the housing assembly and having a rim portion overhung by and adapted to mate with the radially projecting flange of said reflector, and (4) separable refractor mounting means comprising;

(a) a flexible clampband extending around the periphery of the refractor, said clampband being split and having the ends thereof spaced a predetermined distance with each said ends having a raised slotted section;

(b) resilient means cooperating with said clampband and effective for normally urging the ends thereof apart;

(c) a plurality of fastening means disposed around the periphery of said clampband; and (d) a hinge clip for hingedly fastening said refractor to said reflector, said hinge clip having one side including means for pivotal connection to said attachment means of said reflector, said hinge clip having its other side formed with a spaced pair of hooked extensions with indentations in the opposed edges thereof, said hooked sections being insertable into said raised slotted sections in the clampband ends when said clampband and said resilient means are in a compressed state and said raised slotted sections of said clampband being urged into said indentations when said clampband and resilient means are in an expanded state thereby to effect retention of said hinge clip on said clampband.

8. A luminaire according to claim 7 wherein said flexible clampband has a rim section extending over the rim portion of said refractor.

9. A luminaire according to claim 7 wherein said flexible clampband has upper and lower rim sections extending respectively over the top and bottom surfaces of the rim portion of said refractor.

10. A luminaire according to claim 7 wherein said clampband further comprises a plurality of circumferentially spaced slotted sections and said plurality of fastening means comprises a plurality of latches respectively and pivotally connected to said circumferentially spaced slotted sections, said latches being dimensioned to span between the bottom of the clampband and the top of the radially projecting flange of the reflector and providing direct clamping therebetween.

11. A luminaire according to claim 7 wherein said resilient means comprises a resilient gasket fitted about the rim of said refractor and positioned in said clampband.

12. A luminaire according to claim 11 wherein said resilient gasket includes sealing sections extending inwardly over the upper and lower rim portions of said refractor.

13. A luminaire according to claim 11 wherein said resilient gasket further includes a rim section extending over the outer edge of said clampband for serving as a seal between said clampband and said reflector flange.

14. A luminaire according to claim 7 wherein said refractory attachment means comprises two spaced apart hooked portions and said means of said hinge clip for pivotal connection to said attachment means comprises two slotted sections complementary dimensioned relative to said hooked portions of said attachment means.

* * * * *